United States Patent [19]

Castiglioni et al.

[11] Patent Number: 4,596,125

[45] Date of Patent: Jun. 24, 1986

[54] COMBINATION LOCK

[75] Inventors: Claudio Castiglioni; Italo Azzalin, both of Varese, Italy

[73] Assignee: C.G.V. S.a.s. di Claudio Castiglioni & C., Italy

[21] Appl. No.: 689,154

[22] Filed: Jan. 7, 1985

[30] Foreign Application Priority Data

Jan. 26, 1984 [IT] Italy ..... 19323 A/84

[51] Int. Cl.[4] ..... E05B 37/12

[52] U.S. Cl. ..... 70/312; 70/317; 70/322; 70/326; 70/328; 70/DIG. 21; 70/DIG. 44

[58] Field of Search ..... 70/312, 315–318, 70/322, 323, 326, 327, 328, DIG. 44, 301, 304, 294, 291, 286, 22, DIG. 21, DIG. 23

[56] References Cited

U.S. PATENT DOCUMENTS 1,585,949 5/1926 Tueckmantel ..... 70/312
2,575,674 11/1951 Miller ..... 70/323
3,434,314 3/1969 Atkinson ..... 70/312
4,462,232 7/1984 Yang ..... 70/312

*Primary Examiner*—Robert L. Wolfe
*Assistant Examiner*—Lloyd A. Gall
*Attorney, Agent, or Firm*—Steinberg & Raskin

[57] ABSTRACT

The combination can be set by discs which are toothed on one of their faces. This toothing causes movement of internal bushes or rings which are at least partly contained in seats in a manually controllable slider, which can be moved against a spring when, having set the exact combination, a radial passage in said bushes or rings becomes disposed in a position such as to allow radial movement of the bushes and thus movement of the slider and opening of the lock. The combination can be changed by setting the existing combination and moving the slider and thus the rings, so that these latter disengage from the toothed discs which can thus be rotated into another position without dragging the bushes with them.

6 Claims, 5 Drawing Figures

COMBINATION LOCK

BACKGROUND OF THE INVENTION

This invention relates to a combination lock particularly for products such as cases, bags and the like, comprising an engagement member intended for fixing to one of the two parts of the product, and a combination mechanism fixed to the other part of the container and provided with a latch or pawl arranged to cooperate with said engagement member. The combination mechanism is of the type comprising a series of rotatable discs for setting the combination, an equal series of stop bodies removably engaged with said discs so as to be able to be rotated together therewith, and an element associated with said bodies and slidable against a spring when said bodies assume a predetermined position corresponding to the required combination.

This category of devices substantially includes, for example, those described in Italian patent application No. 22488B/79 of Sept. 7, 1979, in the corresponding U.S. patent Application Ser. No. 175,903 of Aug. 6, 1980, in German patent application No. 2946091 of Nov. 15, 1976 and in U.S. Pat. No. 3,720,082. These devices comprise in particular annular discs, peripherally provided with alphanumerical signs, and traversed by the stop bodies which are in the form of a sleeve, along which the slidable element extends. Essentially, the said main components are disposed concentrically to each other, with the result that said known devices have a height which precludes or limits certain applications, especially where flat locks, i.e. of low height, are advantageous or necessary. Suitably flat locks able to satisfy market requirements are in fact available commercially, but they are particularly complicated and difficult to mount. In particular, such locks comprise a series of setting discs which are coplanar rather than lying in parallel planes.

SUMMARY OF THE INVENTION

The main object of the present invention is to provide a flat lock formed from a small number of components, which is easily mountable and of reliable operation.

This and further objects which will be more apparent from the detailed description given hereinafter are attained by a lock of the aforesaid type, which is characterised essentially in that each combination-setting disc comprises circular toothing on one of its flat faces, in that each stop body is in the form of a ring and contains toothed formations arranged to engage with the toothing of the cooperating disc in such a manner as to move angularly with this latter but allowing a radial movement producing disengagement between the toothed formations and the toothing when a substantially radial path present in said ring faces, when in a predetermined position, a stationary profiled means, and in that said rings are housed in seats in the slidable element in such a manner as to govern its possibility of movement.

BRIEF DESCRIPTION OF THE DRAWINGS

The invention will be more apparent from the detailed description of a preferred embodiment thereof given hereinafter by way of non-limiting example, and illustrated on the accompanying drawing, in which.

DESCRIPTION OF THE PREFERRED EMBODIMENT

Figure 1:
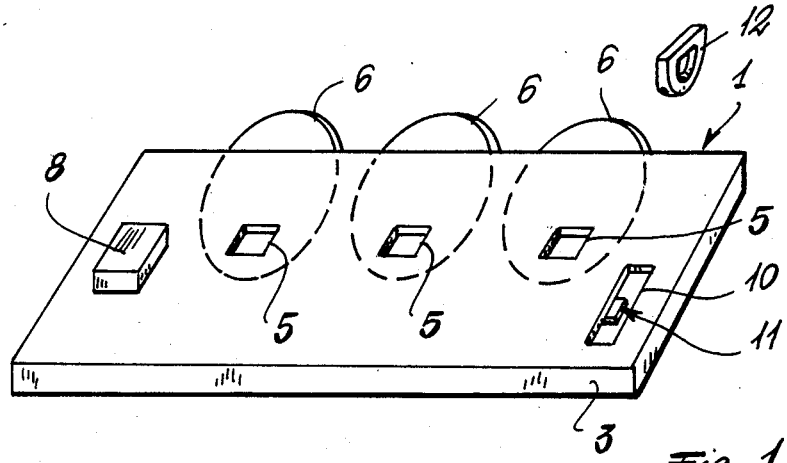
FIG. 1 is a very diagrammatic perspective view of the lock according to the invention.

In the figures, the reference numeral 1 indicates overall the substantially box-like outer casing of the combination lock according to the invention. The casing is formed in particular from two parts 2, 3 connected together in any known manner, and of which one part, namely the lower part 2, comprises a pair of bendable lugs 4 by which the lock is fixed to the case, bag or other object. The upper part 3 of the casing comprises a set of three apertures 5 in which there appears the alphanumerical character present on the combination-setting discs 6 which project partially from the casing in such a manner as to be able to be rotated by the user. Said part 3 also comprises a non-visible aperture traversed by the pins 7 by which the outer control knob 8 is connected to a slidable element, hereinafter known as the slider 9 and described in detail. There is also a further aperture 10 faced by the end of a pawl 11 which serves to keep the case, bag or similar article closed when engaged in a known eyelet 12 fixed to the mobile part of the article.

In the lower part 2 of the casing there is mounted a member molded of plastics material, for example nylon, and indicated overall by 13, for supporting the combination mechanism and the other operational parts of the lock. In particular, the pawl 11 is slidably mounted in a guide slot 14, and is loaded by a spring 15 which is also housed in a part of said slot. The spring acts against a right-angularly bent end 16 of the pawl 11, which comprises at an intermediate point two lateral opposing appendices 17 bent at a right angle and projecting from interruptions 18 in said guide slot 14. One of said appendices 17 penetrates into a lateral notch 19 of the slider 9, to adhere, under the thrust of the spring 15, against that edge 20 of said notch which is situated to the right in FIG. 2. The effect of this is that the pawl 11 retracts, i.e. moves in the direction of the arrow A, when the user having set the correct combination pulls the knob 8, to move the slider 9 in the same direction.

The slider 9 is preferably constituted by a flat metal strip resting on the base of the member 13 and guided along discontinuous opposing lateral surfaces 21, 22 present in the member 13. The slider also comprises three seats 23 in the form of interrupted circles, in each of which there is disposed a stop body 24, known hereinafter as the stop ring. The ring 24 comprises, on its lower surface (with respect to FIG. 2), a radial groove or path 25 which is preferably closed outwards and opens into the central bore 26 of the ring 24. On its upper face, the ring in question comprises in diametrically opposing positions two protuberances or radial teeth 27 the purpose of which is to enable the ring to be rotated by the respective combination-setting disc 6, which for this purpose comprises on its lower face circularly-disposed toothing 28 with which the said teeth 27 engage. It should be noted that the toothing 28 is shaped in such a manner as to allow radial movement of the ring 24 relative to the combination-setting disc 6.

A stationary profiled means 29 known hereinafter as the "projection" and formed integrally with the member 13 extends into the central bore 26 of each ring 24, it being elongated in the direction A and being of such a size, particularly in said direction, that the groove 25 can at least partly receive said projection 29 when said groove is aligned with said direction A.

In other words, the groove 25 must be aligned with said direction when it is required to move the slider 9 in this direction, namely in the direction of the arrow A, to thus displace the pawl 11 and finally open the lock. This alignment occurs when the exact combination has been set. When the ring 24 is in other positions, movement in the direction of the arrow A is prevented. A centering pin 29A with an enlarged head can be provided on the projection 29, its purpose being to facilitate retention of the components during mounting.

The combination-setting discs 6 rest on discrete steps 30 present in the member 13, and are guided circularly by the arcuate walls 31 which define said steps. In addition to the toothing 28, the discs 6 comprise on their lower face a series of circularly-disposed centering recesses 32 into which there penetrate wedge-shaped teeth 33 disposed on elastically deformable brackets 34 projecting from a wall 35 of the member 13. The discs 6 are provided on their flat upper face 6A with alphanumerical indications 6B, which are designed one at a time to face the apertures 5 and enable the combination to be set. In the center of the upper face of the discs 6 there is provided a hole 36 which receives a compression spring 37 acting on the combination-setting disc and on the upper part 3 of the casing 1.

The operation is as follows:

Assuming that the article fitted with the lock is to be opened, the user sets the combination by means of the combination-setting discs, by observing it through the display apertures 5. When the exact combination has been set, the rings 24 all lie in the position shown for example in FIG. 2. By operating the knob 8, the user can now move the slider 9, and the engagement of the edge 20 of this latter with the appendix 17 results in displacement of the pawl 11 in the direction of the arrow A, thus freeing the eyelet 12. The article can then be opened.

Figure 2:
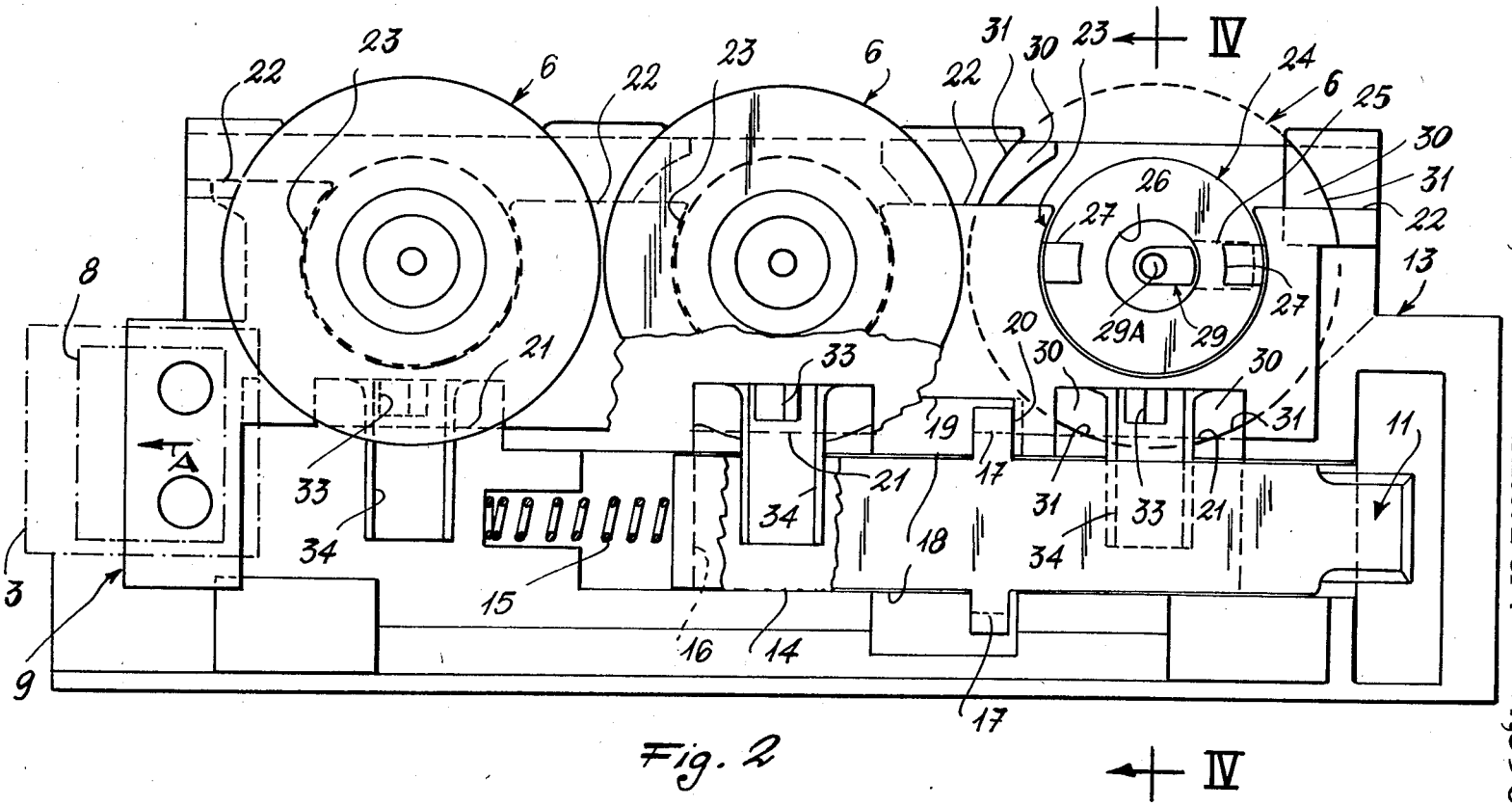
FIG. 2 is a plan view of the lock after removing the two components which constitute the box casing of said lock.

When the user releases the knob 8, the spring 15 returns the said members into the position of FIG. 2, and if he wishes he can move the combination-setting discs 6 without this preventing reclosure of the article. This is because when the eyelet in inserted into the aperture 10, it causes only the pawl 11 to move against the spring 15, because of the presence of the notch 19 into which the appendix 17 can move.

Figure 5:
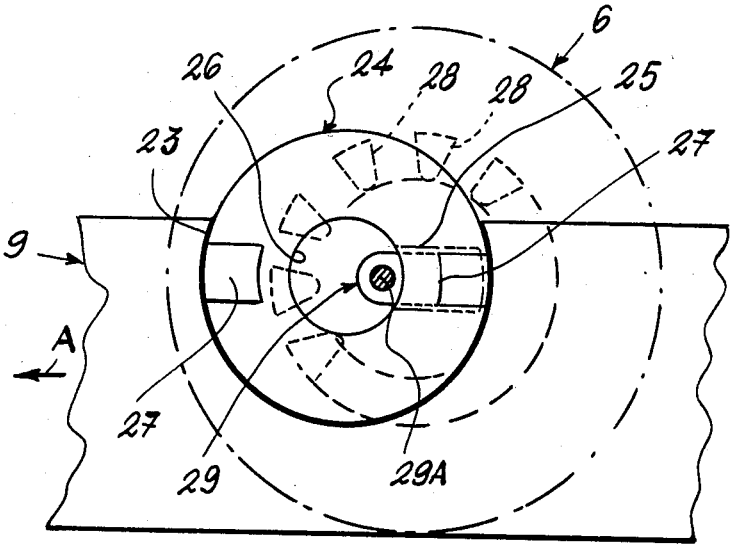
FIG. 5 is a diagrammatic plan view showing the lock opening position, in which it is possible to change the combination.
Figure 3:
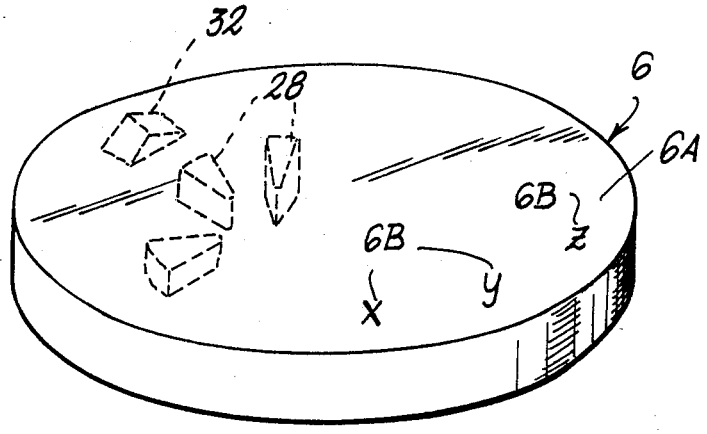
FIG. 3 is a partially exploded diagrammatic perspective view of a combination-setting disc, the relative stop ring and the slidable element which houses this latter.
Figure 3:
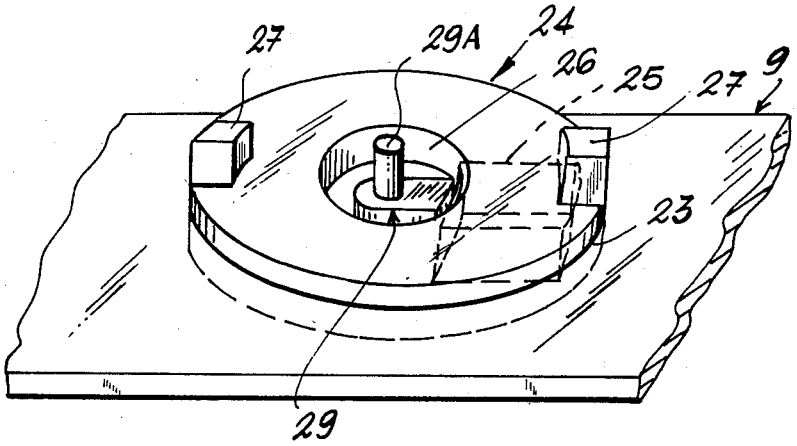
Figure 4:
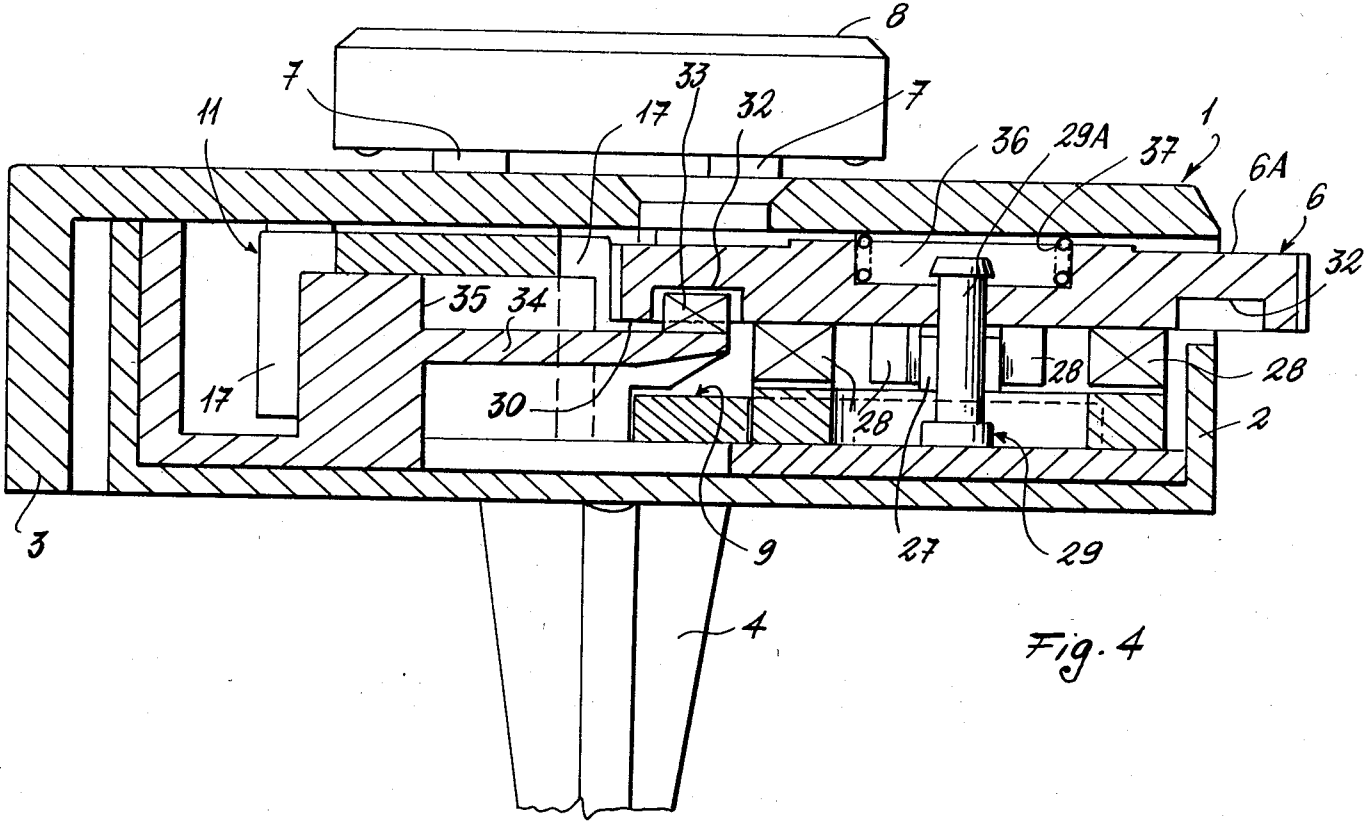
FIG. 4 is a section on the line IV—IV of FIG. 2, to an enlarged scale.

When it is required to change an existing combination, this existing combination is firstly set so that the rings 24 move into the position of FIGS. 2 and 3. In this position, the slider 9 is moved in the direction of the arrow A. The rings 24 then move relative to the respective combination-setting disc 6 so that the toothing 27, 28 mutually disengage as shown in FIG. 5. While holding the slider 9 in this position, the user rotates the combination-setting discs 6 until they assume the new required combination, displayed in the apertures 5. By virtue of the mutual disengagement of the toothing 27, 28, and the insertion of the projections 29 into the grooves 25, the rings 24 do not participate in this movement of the combination-setting discs 6. The user then releases the knob 8 and the slider 9 moves in the opposite direction to the arrow A, the various members assuming the position corresponding to that of FIG. 2.

Although only one preferred embodiment of the invention has been described, it will be simple for an expert of the art in possession of the inventive idea to make numerous modifications, which must however all fall within the scope of the invention itself.

What is claimed is:

1. An improved combination lock, comprising an engagement member intended for fixing to one of the parts of an article, and a combination mechanism fixed to the other part of the article and provided with a pawl arranged to cooperate with said engagement member, said mechanism comprising a series of rotatable discs for setting the combination, an equal series of stop bodies removably engaged with said discs so as to be able to be rotated together therewith, and an element associated with said bodies and slidable against a spring when said bodies assume a predetermined position corresponding to the required combination, characterised in that: (a) the combination-setting discs comprise circular toothing on one of their flat faces; (b) the stop bodies are of ring shape and contain toothed formations arranged to engage the toothing of the cooperating combination-setting disc in such a manner as to move angularly with this latter, but allowing a radial movement of said bodies with respect to said discs producing disengagement between the toothed formations and toothing when a radial path present in said ring faces, when in a predetermined position, a stationary profiled means; and (c) said stop bodies are housed in seats in the slidable element in such a manner as to govern its possibility of movement.

2. A lock as claimed in claim 1, wherein the combination-setting discs comprise on the same face as the circular toothing a ring of recesses which are arranged to cooperate with elastically deformable stationary formations in order to correctly position the discs.

3. A lock as claimed in claim 1, wherein the radial path of the stop bodies is constituted by a radial groove.

4. A lock as claimed in claim 1, wherein the slidable element is substantially flat, and comprises a series of open circular ones of said seats in which the stop bodies are rotatably disposed.

5. A lock as claimed in claim 1, wherein the stationary means is a projection shaped in such a manner that it becomes at least partly inserted, when the stop body is in a given angular position, into the radial groove of said stop body when the slidable element is moved in a direction parallel to said groove.

6. A lock as claimed in claim 1, wherein the slidable element comprises a lateral notch in which there is disposed an appendix of the pawl so that these latter have a certain autonomy of movement against a spring.

* * * * *